United States Patent [19]

Siegel

[11] Patent Number: 4,595,914

[45] Date of Patent: Jun. 17, 1986

[54] SELF-TESTING COMBUSTION PRODUCTS DETECTOR

[75] Inventor: Stephen L. Siegel, Hanover Park, Ill.

[73] Assignee: Pittway Corporation, Aurora, Ill.

[21] Appl. No.: 483,859

[22] Filed: Apr. 11, 1983

[51] Int. Cl.[4] ..... G08B 29/00; G08B 17/10

[52] U.S. Cl. ..... 340/515; 250/384; 340/516; 340/529; 340/629

[58] Field of Search ..... 340/514, 515, 516, 629, 340/630, 529; 250/381, 384, 573, 574, 382, 385 R

[56] References Cited

U.S. PATENT DOCUMENTS

| | | | |
|---|---|---|---|
| 2,473,314 | 6/1949 | Toulon | 340/516 |
| 3,143,161 | 8/1964 | Graves et al. | 340/515 |
| 3,530,450 | 9/1970 | Walthard et al. | 340/629 X |
| 3,543,260 | 11/1970 | Engh | 340/516 |
| 3,657,713 | 4/1972 | Sasaki et al. | 340/514 |
| 3,678,510 | 7/1972 | Walthard et al. | 340/629 X |
| 3,683,372 | 8/1972 | Horn | 340/515 |
| 3,882,477 | 5/1975 | Mueller | 340/515 X |
| 3,928,849 | 12/1975 | Schwarz | 340/515 |
| 4,097,850 | 6/1978 | Conforti | 340/514 |
| 4,099,178 | 7/1978 | Ranney et al. | 340/515 |
| 4,199,755 | 4/1980 | Tanaka | 340/630 |
| 4,232,307 | 11/1980 | Marsocci | 340/515 |
| 4,246,572 | 1/1981 | Larsen | 340/629 X |
| 4,302,753 | 11/1981 | Conforti | 340/628 |
| 4,306,230 | 12/1981 | Forss et al. | 340/630 |
| 4,321,466 | 3/1982 | Mallory et al. | 340/630 X |
| 4,388,615 | 6/1983 | Ford et al. | 340/516 |

*Primary Examiner*—James L. Rowland
*Assistant Examiner*—Daniel Myer
*Attorney, Agent, or Firm*—Emrich & Dithmar

[57] ABSTRACT

A self test circuit for a combustion products detector automatically periodically tests whether the sensitivity of the sensor is in a predetermined range between minimum and maximum sensitivities. Transistor switches selectively connect different test impedances across the sensor for respectively simulating two amounts of combustion products, one of which is slightly less than the amount corresponding to the maximum sensitivity level and the other of which is slightly greater than the amount corresponding to the minimum sensitivity level. If the sensor either produces a smoke output signal in response to the first test or fails to produce an output signal in response to the second test, then the smoke alarm is actuated after the tests are completed to produce a unique fault signal, the alarm annunciator being inhibited during the test.

16 Claims, 2 Drawing Figures

SELF-TESTING COMBUSTION PRODUCTS DETECTOR

BACKGROUND OF THE INVENTION

The present invention relates to combustion products detectors and, in particular, to means for testing the sensitivity of such detectors.

Devices for detecting combustion products, such as smoke, are principally of two types, viz., ionization-type detectors and photoelectric detectors. The principles of the present invention are applicable to any type of combustion products detector, although the preferred embodiment is described in connection with an ionization-type detector In an ionization-type detector, the sensor is typically an active ionization chamber which is relatively open to ambient air. A reference impedance is typically provided by a reference ionization chamber which is relatively closed to ambient air, a reference chamber which is open to ambient air but insensitive to products of combustion, or a physical resistor. Each of the chambers includes a pair of spaced electrodes, or the chambers may share a common electrode therebetween, and means are provided, such as a source of radioactive energy, for ionizing air molecules between the electrodes. With the chambers or chamber and resistor in series to form a voltage divider, and with a voltage applied thereacross, an electric field is generated between the electrodes to establish a current flow through the chambers or chamber and resistor by movement of ions between the electrodes. The potential at a sensing electrode at the junction between the active chamber and reference impedance is then in accordance with the relative impedances of the two elements.

A change in the ambient conditions, such as the presence of combustion products, affects the ion current flow through the series elements and therefore the impedances thereof. The voltage at the sensing electrode is monitored by a detection circuit and when it exceeds a preselected alarm level, the detection circuit energizes a suitable alarm circuit. In self-contained, i.e., battery-powered, combustion products detectors of this type, it is known to provide a battery monitoring circuit which will cause a low battery signal to be generated when the battery has been depleted to near a level at which successful operation of the alarm circuit is no longer assured.

It is known to provide in combustion products detectors means for testing the operation thereof. In particular, means have been provided for testing the sensitivity of the combustion products sensor by simulating the presence of combustion products. In ionization-type detectors, this test means may comprise a manually-operated switch for connecting an impedance across the ionization chambers, thereby to change the voltage thereacross so that the sensing electrode voltage is equal to that which would be produced if combustion products were present in an amount beyond which the generation of an alarm is necessary. Such arrangements are disclosed, for example, in U.S. Pat. Nos. 4,097,850 and 4,246,572. These test devices simply check to see if the sensitivity of the sensor is above a predetermined minimum sensitivity. But it is important that the sensitivity not be too high, so as to avoid frequent false alarms. No prior test devices are concerned with the maximum sensitivity of the sensor.

All such manually operated test devices rely upon the user to remember to test the combustion products detector at regular intervals. But users frequently forget to make such tests. Furthermore, since combustion products detectors are typically located on ceilings or other relatively difficult to reach locations, manual testing of the device may be sufficiently inconvenient to deter the user from making such tests.

It is also known to provide a circuit for selfchecking of the sensitivity of a combustion products detector. Such an arrangement is disclosed in U.S. Pat. No. 4,306,230 and No. 4,302,753, which disclose continuous monitoring of the clear-air voltage from the sensor. But those devices necessitate an additional voltage comparator for the clear-air voltage monitoring, and they check only to be sure that the sensitivity is above a minimum sensitivity level. Furthermore, the device of Pat. No. 4,302,753 may not properly check this minimum sensitivity level since the sensing electrode voltage changes with various smoke levels and is typically nonlinear due to chamber saturation, and large errors in tested smoke levels may therefore result.

There have also been provided various types of fault detection circuits which automatically periodically conduct a self-test of a system in order to detect the presence of certain faults. Such systems are disclosed, for example, in U.S. Pat. No. 3,928,849 and 4,199,755. But none of these periodic self-testing circuits are designed for testing sensitivity of a combustion products detector. Typically, prior combustion products detectors which test sensitivity by simulating combustion products, operate on the principle that the normal smoke alarm should operate under the test conditions. If the alarm fails to operate, due to improper sensitivity of the sensor, a threat to life safety will occur. There is, therefore, a need for a combustion products detector which will provide an automatic, positive indication when the sensitivity fails to meet the test criteria for proper operation.

SUMMARY OF THE INVENTION

It is a general object of the present invention to provide an improved combustion products detector which includes sensitivity testing means which avoids the disadvantages of prior combustion products detectors, while affording additional structural and operating advantages.

An important object of this invention is the provision of a combustion products detector which includes means for testing to determine whether the sensitivity of the sensor is below a predetermined maximum sensitivity.

It is another object of this invention to provide a combustion products detector of the type set forth, which includes means for automatically periodically testing the sensitivity of the sensor.

Still another object of this invention is the provision of a combustion products detector of the type set forth, which includes means for testing whether the sensitivity of the sensor is in a predetermined range between the minimum and maximum sensitivities.

It is another object of this invention to provide a combustion products detector having a sensitivity testing means which simulates combustion products and provides a positive indication when the sensitivity fails to meet the test criteria.

These and other objects of the invention are attained by providing a combustion products detector having a sensor for producing an output signal in response to the presence of an amount of combustion products in excess of a threshold amount, wherein the threshold amount varies inversely with the sensitivity of the sensor, and wherein the desired sensitivity is in a predetermined range between minimum and maximum sensitivities, the improvement comprising: test means for simulating the presence of combustion products in an amount slightly less than the amount corresponding to the maximum sensitivity, test means for simulating the presence of combustion products in an amount slightly greater than the amount corresponding to the minimum sensitivity, control means for actuating the test means, and alarm means coupled to the sensor and responsive to an output signal therefrom for producing an alarm indication, whereby an alarm indication is produced in response to actuation of the test means when the sensitivity of the sensor exceeds the maximum sensitivity or when the sensitivity of the sensor is less than the minimum sensitivity.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 2:
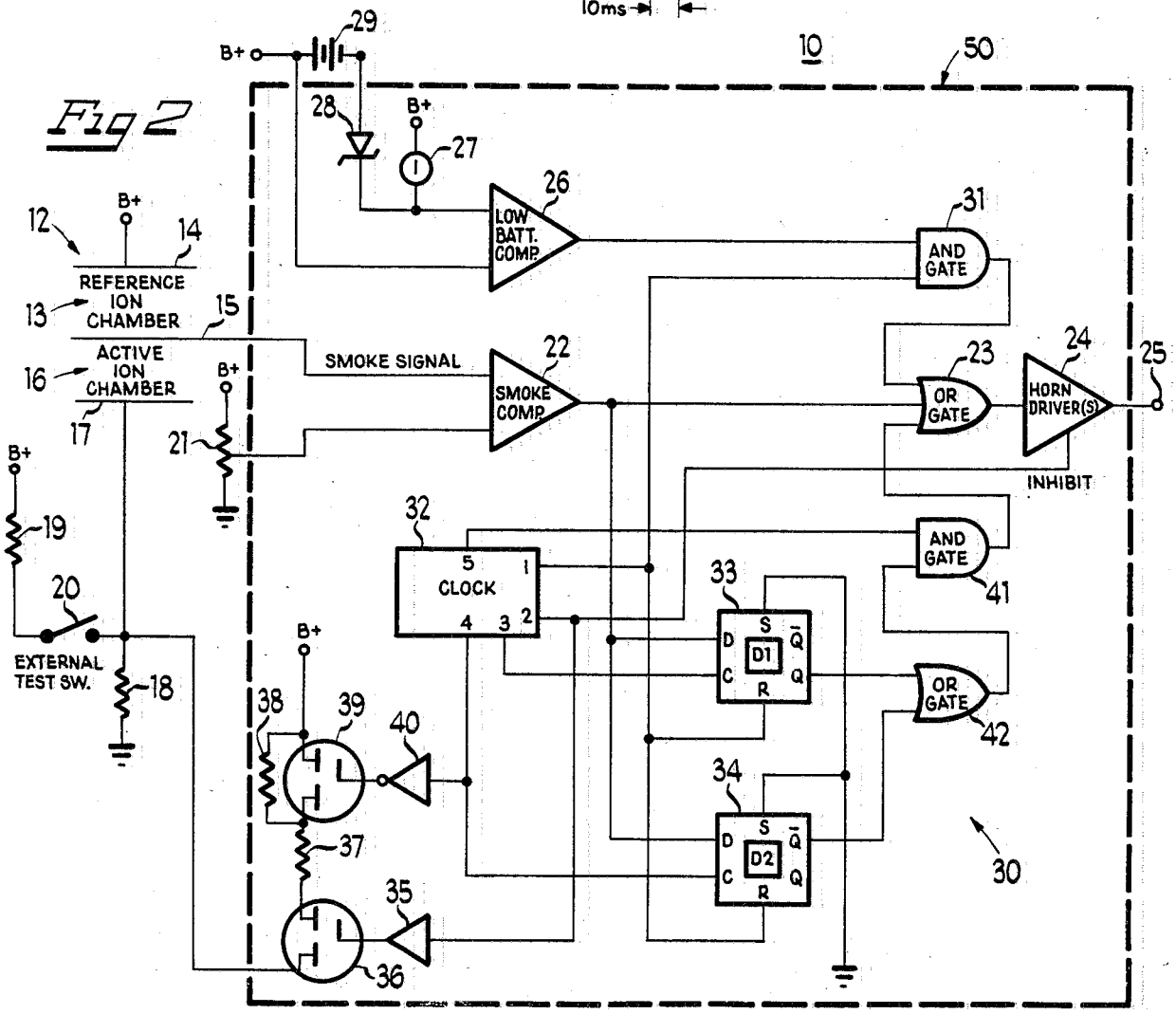
FIG. 2 is a partially schematic and partially block circuit diagram of the combustion products detector of the present invention.

Referring to FIG. 2 of the drawings, there is illustrated a combustion products detector, generally designated by the numeral 10, constructed in accordance with and embodying the features of the present invention. The detector 10 includes circuitry, which is connected to a sensor 12 of the ionization type. The sensor 12 includes a reference ionization chamber 13 having an electrode 14 connected to a positive battery supply voltage (B+) and an electrode 15, which are maintained in a spaced relationship by a spacer (not shown) of insulating material, the electrodes 14 and 15 and the spacer together forming a relatively imperforate closure. The sensor 12 also includes an active ionization chamber 16 which has an electrode 17 which may be in the form of a relatively perforate conductive housing cooperating with the electrode 15 to define the active ionization chamber 16, the electrode 15 being common to both chambers 13 and 16.

Means are provided, such as a radioactive source (not shown) for ionizing air molecules within both of the chambers, whereby with a voltage applied across the electrodes 14 and 17 an electric field is generated within each chamber to establish a current flow therethrough by movement of the ions between the electrodes in a well known manner. The reference and active chambers 13 and 16 thus form a voltage divider and they are connected in series with a resistor 18 between the B+supply and ground. Thus, the voltage at the electrode 15 is a function of the relative impedances of the chambers 13 and 16. Resistor 18 is much lower in impedance than the ionization chambers and will therefore normally not influence the sensing electrode voltage value. Connected in parallel with the sensor 12 is the series combination of a resistor 19 and a manually-operated, normally-open test switch 20 for manually testing to see that the sensitivity of the sensor 12 is above a predetermined minimum sensitivity in a well known manner, as was described in greater detail in the aforementioned U.S. Pat. No. 4,097,850.

The combustion products detector 10 also includes a potentiometer 21 connected across the B+supply and having a wiper which is connected to the reference terminal of a smoke comparator 22, the other terminal of the comparator 22 being connected to the sensor electrode 15. The output of the comparator 22 is connected to one of three inputs of an OR gate 23, the output of which is connected to the input of a horn driver 24, the output of which is connected to an output terminal 25 to which may be connected a suitable horn (not shown). The horn driver 24 may be a single driver to activate an associated electromechanical horn or multiple drivers to operate a piezoelectric horn. It will be appreciated that other types of annunciators could also be provided.

The combustion products detector 10 also includes a low battery comparator 26 having a reference input terminal which is connected to an internal reference voltage provided by a current source 27 connected to the B+supply, the reference voltage being regulated by a Zener diode 28. The anode of the Zener diode 28 is connected to the negative terminal of a battery 29, the positive terminal of which is the B+supply and is connected to the other input terminal of the comparator 26. The output of the low battery comparator 26 is connected to one of two inputs of an AND gate 31, the output of which is connected to one of the inputs of the OR gate 23. The other input of the AND gate 31 is connected to the output line 1 of a clock 32, which output is also connected to the reset terminals of two D-type flip-flops 33 and 34, the set terminals of which are connected to ground. The data inputs of the flip-flops 33 and 34 are connected to the output of the smoke comparator 22, while the clock inputs of the flip-flops 33 and 34 are respectively connected to output lines 3 and 4 of the clock 32.

The clock 32 also has an output line 2 which is connected to an inhibit terminal of the horn driver 24 and is also connected through an amplifier 35 to the gate of a metal oxide semiconductor field-effect transistor ("MOSFET") switch 36, the drain of which is connected to the electrode 17 of the sensor 12. Connected in series between the source of the transistor 36 and the B+supply are two resistors 37 and 38. The resistor 38 is connected across the source and drain of a MOSFET 39, the gate of which is connected to the output of an inverter amplifier 40, the input of which is connected to an output line 4 of the clock 32. It will be appreciated that other types of electronic switch devices could be used in place of the MOSFETS 36 and 39 and associated amplifiers 35 and 40. The clock 32 also has an output line 5 which is connected to one input of an AND gate 41, the other input of which is connected to the output of an OR gate 42 having two input terminals which are respectively connected to the Q output of the flip-flop 33 and the inverted Q output of the flip-flop 34. The output terminal of the AND gate 41 is connected to the other input terminal of the OR gate 23.

Referring now also to the waveform diagrams in FIG. 1, the operation of the combustion products detector 10 will be described. In normal operation, in the presence of combustion products the impedance of the active ionization chamber 16 will increase. When the voltage at the electrode 15 reaches the preset level at the external reference, as determined by the potentiometer 21, an output will be produced from the smoke comparator 22, which is transmitted through the OR gate 23 to activate the horn driver 24. The associated horn (not shown) will remain activated as long as the amount of combustion products is sufficient to maintain the voltage of the electrode 15 at or above the external reference.

If it is desired to manually test the operation of the combustion products detector 10, the external test switch 20 is closed, thereby connecting the voltage divider consisting of resistors 19 and 18 in parallel with the sensor 12. This operates to raise the voltage at the electrode 15 in the same manner as it would be raised by the presence of actual combustion products in an amount sufficient to actuate the alarm. Accordingly, the closure of the test switch 20 acts to simulate the presence of combustion products, raising the voltage of the electrode 15 above the external reference to produce an output from the smoke comparator 22.

There is also provided a low battery comparator 26 for monitoring the B+supply voltage, and producing a fault signal in the event that the battery voltage drops below a level necessary for proper operation of the combustion products detector 10. Thus, when the B+supply voltage drops below an internal reference level, as determined by the reference source 27, a continuous output would be produced from the low battery comparator 26. This output signal is applied to one terminal of the AND gate 31, the other input of which is applied from output line 1 of the clock 32. This clock signal is illustrated in FIG. 1, the various waveforms of which are designated by the line numbers corresponding to the output lines of the clock 32. It can be seen that the waveform on line 1 comprises a short pulse 43, typically approximately 10 ms in duration, which is periodically repeated at relatively infrequent intervals, typically about one minute. In the presence of an output signal from the low battery comparator 26, each clock pulse 43 on line 1 produces an output from the AND gate 31, which is applied through the OR gate 23 to activate the horn driver 24. Thus, in the event of low battery voltage, the combustion products detector 10 will produce a short 10 ms "beep" about once per minute. This intermittent signal is easily distinguishable from the continuous alarm signal which is produced in the presence of combustion products, for unambiguously indicating the low battery condition.

All of the foregoing are well known operating features of combustion products detectors. Referring now to the waveforms on lines 2–5 of FIG. 1, the novel aspects of the self-test circuit 30 of the present invention will be described in detail. The clock signal on line 1 for enabling the low battery indication, is also applied to the reset terminals of each of the flip-flops 33 and 34 for resetting them. Thus, about once each minute each of these flip-flops 33 and 34 is reset, the occurrence of this reset signal being at a time designated $t_0$ in FIG. 1.

It is a significant aspect of the present invention that a fault indication will be produced in response to the self-test, only in the event that the combustion products detector 10 is not operating properly, i.e., in the event that it fails the self-test. Accordingly, at time $t_1$, approximately 15 ms after the termination of each pulse 43 on line 1, the clock 32 produces an output pulse 44 on line 2, which is applied to the inhibit terminal of the horn driver 24. This prevents actuation of the horn driver 24 for the duration of the inhibit pulse 44 (about 2 seconds), so that an alarm indication cannot be produced while the self-test is in progress. This inhibit is removed at the end of the pulse 44 so that an alarm signal can be produced after the self-test is completed. The pulse 44 on line 2 is also applied through the amplifier 35 to the gate of the MOSFET 36, turning it on and thereby connecting the voltage divider consisting of resistors 37, 38 and 18 in parallel with the sensor 12. This causes a change in the voltage at the electrode 15 in generally the same manner as was described above in connection with the operation of the manual external test switch 20.

Because of the fact that there are different types of combustion and, accordingly, different types of combustion products which can trigger the sensor 12, it is not possible to set the sensitivity of the sensor 12 at a level which will respond to all types of combustion products equally. Thus, for example, while a certain concentration of one combination of combustion products from a particular type of combustion might be sufficient to raise the voltage at the electrode 15 above the external reference level, another combination of combustion products from a different type of combustion might have to be present in a slightly higher concentration in order to raise the voltage of the electrode 15 above the reference level. Thus, it is typically the practice to establish the sensitivity of the sensor 12 at a level such that it will be sensitive enough to be capable of responding to all types of fires. In a preferred embodiment of the invention, this minimum sensitivity is such that the sensor will respond to produce a smoke alarm indication when the amount of combustion products reaches 1.5% obscuration per foot (the higher the sensitivity of the sensor 12, the lower the amount of combustion products necessary in order to trigger it into alarm).

But if the sensitivity is too high, the combustion products detector 10 will frequently produce false or nuisance alarms (such as in the event of someone smoking a cigarette or cooking in the general vicinity of the combustion products detector). Thus, in a preferred embodiment, it is desired that the maximum sensitivity of the sensor 12 be such that it will not be triggered into alarm by an amount of combustion products at 0.5% obscuration per foot or less. Thus, it is desired that the sensitivity of the sensor 12 be in a range corresponding to amounts of combustion products in the range between 0.5% and 1.5% obscuration per foot.

The values of the resistors 37 and 38 are chosen so that they will cause a change in voltage at the electrode 15 slightly less than the minimum needed to cause an output from the smoke comparator 22 to occur. In other words, the connection of the resistors 37 and 38 across the sensor 12 simulates an amount of smoke just below the amount corresponding to the maximum sensitivity of the sensor 12, i.e., slightly less than 0.5% obscuration per foot. Thus, if the sensitivity of the sensor 12 is in the desired range, it will not respond to this combustion products simulation for producing an output from the smoke comparator 22. If, on the other hand, sensitivity of the sensor 12 is too high, i.e., the clear-air voltage of the electrode 15 is greater than it should be, the closure of the transistor switch 36 will raise the voltage of the electrode 15 above the external reference and produce an output signal from the smoke comparator 22. This is again applied to the horn driver 24 through the OR gate 23, but the horn driver 24 is not activated since it is being inhibited by the pulse 44 on clock line 2.

However, the output from the smoke comparator 22 is also applied to the data terminals of each of the flip-flops 33 and 34 which were just reset at time $t_0$. The flip-flop 33 now has its set and reset terminals at ground or logic low level. In this condition, the Q terminal will be low and can become high only in the event that there is a logic high at the data terminals and a positive-going transition at the clock terminal. At time $t_1$ the clock 32 also produces on line 3 a negative-going pulse 45, of about 1 second duration. When the data input of the flip-flop 33 is high, as a result of an output signal from the smoke comparator 22, the positive-going transition 46 at the end of the clock pulse 45 at time $t_2$ will cause the Q output of the flip-flop 33 to become high and remain high until reset at the next clock pulse 43 on line 1, about one minute later. This output signal is applied through the OR gate 42 to one input of the AND gate 41. However, the other input to the AND gate 41, which is connected to clock line 5, is low at time $t_2$ (see FIG. 1) so that no output is produced from the AND gate 41 at this time. If, on the other hand, the maximum sensitivity of the sensor is normal, no output from the smoke comparator 22 will be obtained during pulse 45 and the Q output of flip-flop 33 will remain low at transition 46, and no signal will be applied to AND gate 41.

Simultaneously with the positive going transition 46 of the pulse 45 at time $t_2$, the clock 32 produces on line 4 a negative going pulse 47, having a duration of about 1 second, which is applied to the inverter amplifier 40 and to the clock input terminal of the flip-flop 34. The inverter amplifier 40 produces a high output which is applied to the base of the transistor switch 39, switching it on for shorting the resistor 38. Thus, now only resistor 37 forms a voltage divider with resistor 18 which is connected across the sensor 12. The value of the resistor 37 is selected to cause a change in the voltage at the electrode 15 which will be just in excess of that which would be produced by an amount of smoke corresponding to 1.5% obscuration per foot. In other words, the connection of the resistor 37 alone, together with resistor 18, across the sensor 12 simulates an amount of smoke just in excess of that corresponding to the minimum permissible sensitivity for the sensor 12. Accordingly, if the sensitivity of the sensor 12 is in the desired range, the voltage at the electrode 15 will be elevated above the external reference and the smoke comparator 22 will produce an output signal. This does not activate the horn driver 24 because it is still inhibited by the pulse 44. The output of the smoke comparator 22 is also applied to the data terminal of the flip-flop 34. Now the positive going transition 48 of the pulse 47 will cause the inverted Q output terminal of flip-flop 34 to change state to a logic low level at time $t_3$ (the inverted Q output is normally at a logic high level when the set and reset terminals are at ground level, the inverse of the Q output described previously), so as to not affect the output of the OR gate 42. The inverted Q output will remain at the logic low level until reset at the next clock pulse 43, about 1 minute later.

If, on the other hand, the sensitivity of the sensor 12 is too low, no output will be produced from the smoke comparator 22, so that the data terminal of the flip-flop 34 remains low. In this event, when the positive going transition 48 of the pulse 47 is applied to the clock terminal of the flip-flop 34 at time $t_3$, the inverted Q output will remain high, causing the output of the OR gate 42 to go high and be applied to the AND gate 41. But, as explained above, since the other input to the AND gate 41 is low, no output is produced therefrom.

The pulses 44 and 47 both terminate at time $t_3$. Thus, at this time, the transistor switches 36 and 39 are both opened, disconnecting the resistors 37 and 38 and, simultaneously the inhibit is removed from the horn driver 24. About 15 ms thereafter, at time $t_4$, two short (preferably about 10 ms) pulses 49, with 10 ms in between are produced on line 5 of the clock 32 and applied to the AND gate 41. Thus, at this time if the other input of the AND gate 41 is also high as a result of an output from the OR gate 42, the AND gate 41 will produce two brief high outputs which are applied through the OR gate 23 to activate the horn driver 24 and produce a unique fault indication. Thus, at the time of the clock pulses 49, if there is a high output from either the Q terminal of flip-flop 33 (indicating that the sensitivity of the sensor 12 is too high), or from the inverted Q output of the flip-flop 34 (indicating that the sensitivity of the sensor is too low), two 10 ms "beeps" close together will be produced to indicate this condition. It will be appreciated that the sequence of pulses indicated in FIG. 1 on lines 1–5 are repeated about once each minute. Thus in the event that the sensor 12 fails either one of the maximum or minimum sensitivity tests, two short, closely spaced "beeps" about once each minute will be produced to indicate this fault condition. If both tests are successfully passed, then there will be no output indication as the Q output of flip-flop 33 and the inverted Q output of flip-flop 34 will both be at a logic low level, resulting in a logic low level at one input of AND gate 41 during pulses 49 at the other input of the AND gate.

Figure 1:
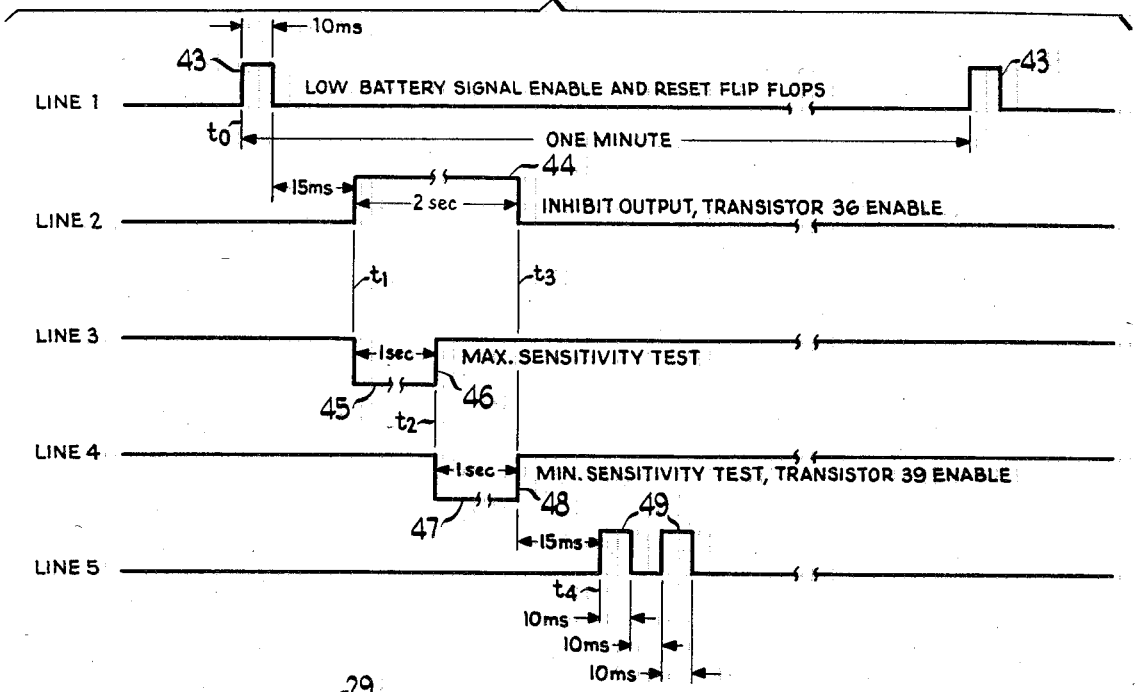
FIG. 1 is a series of waveform diagrams illustrating the various clock signals produced by the test circuitry of the, present invention.

The specific timing indicated in FIG. 1 is merely exemplary, and is not critical. It will be appreciated that other timing sequences could be utilized to achieve substantially the same result. If desired, the circuitry enclosed in the dashed-line 50 could be an integrated circuit. In that case, the test resistors 37 and 38 could alternatively be connected external to the integrated circuit for more precise control, if needed. It will also be appreciated that the self-test circuit 30 could also be utilized for testing the sensitivity of other types of combustion products detectors. In photoelectric detectors, as an example, the light emitter output or light sensor input sensitivity or internal reflective surfaces could be similarly electronically controlled to simulate smoke and accomplish similar results. While the preferred embodiment of the invention has been disclosed with a battery power source, it will be appreciated that the invention could be used with combustion products detectors employing other power sources such as AC, remote power supplies, etc., and may also be used with any type of combustion products detector, such as residential, as described herein, commercial, wherein the alarm and fault outputs are electronic signals to a monitoring system rather than audible annunciations, etc.

From the foregoing, it can be seen that there has been provided an improved apparatus for automatically self-testing sensitivity of a combustion products detector at both ends of the desired sensitivity range, the test method accurately simulating smoke and producing a unique fault output only in the event of failure of the sensitivity test.

I claim:

1. In a combustion products detector having a sensor for producing an output signal in response to the presence of an amount of combustion products in excess of a threshold amount, wherein the threshold amount varies inversely with the sensitivity of the sensor, and wherein the desired sensitivity is in a predetermined range between minimum and maximum sensitivities, the improvement comprising: test means for simulating the presence of combustion products in an amount slightly less than the amount corresponding to the maximum sensitivity, control means for actuating said test means, and alarm means coupled to the sensor and responsive to an output signal therefrom for producing a fault indication, whereby a fault indication is produced in response to actuation of said test means when the sensitivity of the sensor exceeds the maximum sensitivity.

2. The combustion products detector of claim 1, wherein the sensor is an ionization-type sensor.

3. The combustion products detector of claim 1, wherein said test means includes electronic switch means.

4. The combustion products detector of claim 1, wherein said control means includes means for automatically periodically actuating said test means.

5. The combustion products detector of claim 4, and further including manually-operated means for testing the sensitivity of the sensor.

6. The combustion products detector of claim 1, wherein said control means includes timing means maintaining said test means actuated for a predetermined time interval, and means for delaying the production of a fault indication by said alarm means in response to actuation of said test means until after the expiration of said predetermined time interval.

7. The combustion products detector of claim 6, wherein said delaying means includes means for inhibiting the operation of said alarm means during said predetermined time interval.

8. The combustion products detector of claim 1, wherein said test means includes electronic switch means, said control means including timing means for periodically closing said switch means for a predetermined time interval, means for registering the presence of an output signal from the sensor during said predetermined time interval, means for inhibiting the operation of said alarm means during said predetermined time interval, and means coupled to said registering means and responsive to registration thereby of an output signal from the sensor for causing said alarm means to prodce a fault indication after the expiration of said predetermined time period.

9. In a combustion products detector having a sensor for producing an output signal in response to the presence of an amount of combustion products in excess of a threshold amount, wherein the threshold amount varies inversely with the sensitivity of the sensor, and wherein the desired sensitivity is in a predetermined range between minimum and maximum sensitivites, the improvement comprising: test means having first and second operating conditions, said test means in the first operating condition thereof simulating the presence of a first amount of combustion products slightly less than the amount corresponding to the maximum sensitivity, said test means in the second operating condition thereof simulating the presence of a second amount of combustion products slightly greater than the amount corresponding to the minimum sensitivity, control means for operating said test means in the first and second operating conditions thereof, and alarm means coupled to the sensor and to said control means and operative for producing a fault indication, said control means including means responsive to an output signal from the sensor when said test means is in its first operating condition for causing said alarm means to produce a fault indication, said control means including means responsive to the absence of an output signal from the sensor when said test means is in its second operating condition for causing said alarm means to produce a fault indication, whereby a fault indication is produced in response to operation of said test means when the sensitivity of the sensor is outside the predetermined range.

10. The combustion products detector of claim 9, wherein the sensor is an ionization-type sensor.

11. The combustion products detector of claim 9, wherein said test means includes electronic switch means.

12. The combustion products detector of claim 9, wherein said control means includes means for automatically periodically operating said test means sequentially in its first and second operating conditions.

13. The combustion products detector of claim 12, and further including manually-operated means for testing the sensitivity of the sensor.

14. The combustion products detector of claim 9, wherein said control means includes means for operating said test means for a predetermined time interval during which said test means is operated sequentially in its first and second operating conditions, and and means for delaying the production of a fault indication by said alarm means until after the expiration of said predetermined time interval.

15. The combustion products detector of claim 14, wherein said alarm means includes annunciator means coupled to the sensor and responsive to an output signal therefrom for producing an alarm indication, and means for inhibiting the operation of said annunciator means during said predetermined time interval.

16. The combustion products detector of claim 9, wherein said test means includes first and second electronic switch means, said control means includes timing means for periodically operating said test means for a predetermined time interval during which said test means is sequentially operated in its first and second operating conditions, first register means responsive to the existence of an output signal from the sensor when said test means is operating its first operating condition for producing a first failure signal, second register means responsive to the absence of an output signal from the sensor when said test means is operating in its second operating condition for producing a second failure signal, means for inhibiting the operation of said alarm means during said predetermined time interval, and means responsive to either of said first and second failure signals for causing said alarm means to produce a fault indication after the expiration of said predetermined time interval.

* * * * *